US007428834B1

(12) United States Patent
Lee

(10) Patent No.: US 7,428,834 B1
(45) Date of Patent: Sep. 30, 2008

(54) LOCK FOR UNIVERSAL SERIAL BUS PORTS

(75) Inventor: Miko Lee, Hsinchuang (TW)

(73) Assignee: ABA UFO International Corp., Taipei Hsien (TW)

( * ) Notice: Subject to any disclaimer, the term of this patent is extended or adjusted under 35 U.S.C. 154(b) by 0 days.

(21) Appl. No.: 11/999,815

(22) Filed: Dec. 7, 2007

(30) Foreign Application Priority Data

Sep. 20, 2007 (TW) ..... 96135031 A

(51) Int. Cl.
*E05B 73/00* (2006.01)
*H01R 13/44* (2006.01)

(52) U.S. Cl. ..... 70/57; 70/58; 70/491; 439/133; 439/304; 439/352

(58) Field of Classification Search ..... 70/14, 70/57, 58, 360, 361, 491; 248/551–553; 439/133–135, 147–149, 304, 345, 350, 352, 439/353, 357, 358
See application file for complete search history.

(56) References Cited

U.S. PATENT DOCUMENTS 4,964,284 A * 10/1990 McDaid ..... 70/14
5,169,326 A * 12/1992 Werner ..... 439/134
5,190,466 A * 3/1993 McVey ..... 439/304
5,344,329 A * 9/1994 Faller ..... 439/133
6,735,990 B1 * 5/2004 Murray et al. ..... 70/58
6,991,479 B2 * 1/2006 Miao ..... 439/133
7,150,168 B1 * 12/2006 Kuo ..... 70/491
7,160,137 B1 * 1/2007 Yeh ..... 439/358
7,331,203 B2 * 2/2008 Lee ..... 70/14
2003/0224637 A1 * 12/2003 Ling ..... 439/133
2008/0041125 A1 * 2/2008 Poppe ..... 70/57

* cited by examiner

*Primary Examiner*—Lloyd A Gall
(74) *Attorney, Agent, or Firm*—William E. Pelton, Esq.; Cooper & Dunham LLP

(57) ABSTRACT

A lock for universal serial bus (USB) ports has a shell, a tongue, a slide and a lock cylinder. The shell has a front end opening. The tongue is mounted securely in and protrudes out from the front end opening. The slide is mounted movably in the shell. The lock cylinder is mounted movably in the shell and selectively pushes the slide out of the front opening of the shell. The tongue is inserted in and engages the USB port. The lock cylinder pushes and secures the slide in the USB port under the tongue to lock the tongue in the USB port. Therefore, the USB port is locked and may not be used without permission.

20 Claims, 7 Drawing Sheets

LOCK FOR UNIVERSAL SERIAL BUS PORTS

BACKGROUND OF THE INVENTION

1. Field of the Invention

The present invention relates to a lock, especially to a lock for universal serial bus ports.

2. Description of the Prior Arts

As computer technology advances and notebooks and computer are developed for specialist needs, peripherals have been developed to cater for these specialist needs. The peripherals have their own connectors to connect to corresponding ports of the computers. Connection compatibility was greatly enhanced by universal serial bus (USB) connectors, a uniform connection between most peripherals and computers.

The connection compatibility was further improved by development automatic driver configuration software in operating systems, such as Microsoft Corporations, plug-and-play system for Windows. The automatic driver configuration software detects when a peripheral is connected using the USB port and automatically finds a corresponding driver for the peripheral. Therefore, the peripheral can be used after plugging into the computer through the USB port without manually installing any drivers.

However, improved connection compatibility for USB peripherals has created security issues for hardware owners, especially public use computers including schools, libraries, internet cafe's and the like, since every user can plug portable memory devices into the computer to download and upload any information and program. Confidential information is easily downloaded, or the computer may be intentionally targeted with malware including viruses, worms Trojan horses and the like.

To overcome the shortcomings, the present invention provides a lock for locking a universal serial bus port to mitigate or obviate the aforementioned problems.

SUMMARY OF THE INVENTION

The main objective of the present invention is to provide a lock for universal serial bus (USB) ports. The lock has a shell, a tongue, a slide and a lock cylinder. The shell has a front end opening. The tongue is mounted securely in and protrudes out from the front end opening. The slide is mounted movably in the shell. The lock cylinder is mounted movably in the shell and selectively pushes the slide out of the front opening of the shell. The tongue is inserted in and engages the USB port. The lock cylinder pushes and secures the slide in the USB port under the tongue to lock the tongue in the USB port. Therefore, the USB port is locked and may not be used without permission.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
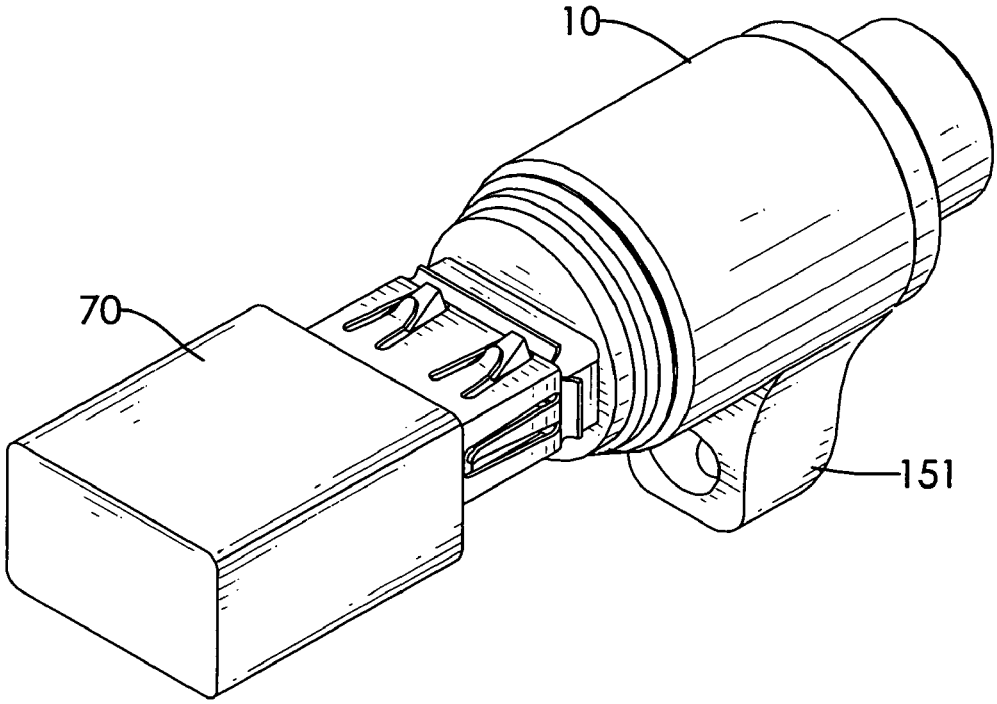
FIG. 1 is an operational perspective view of a lock for universal serial bus (USB) ports, shown locked in a USB port.
Figure 2:
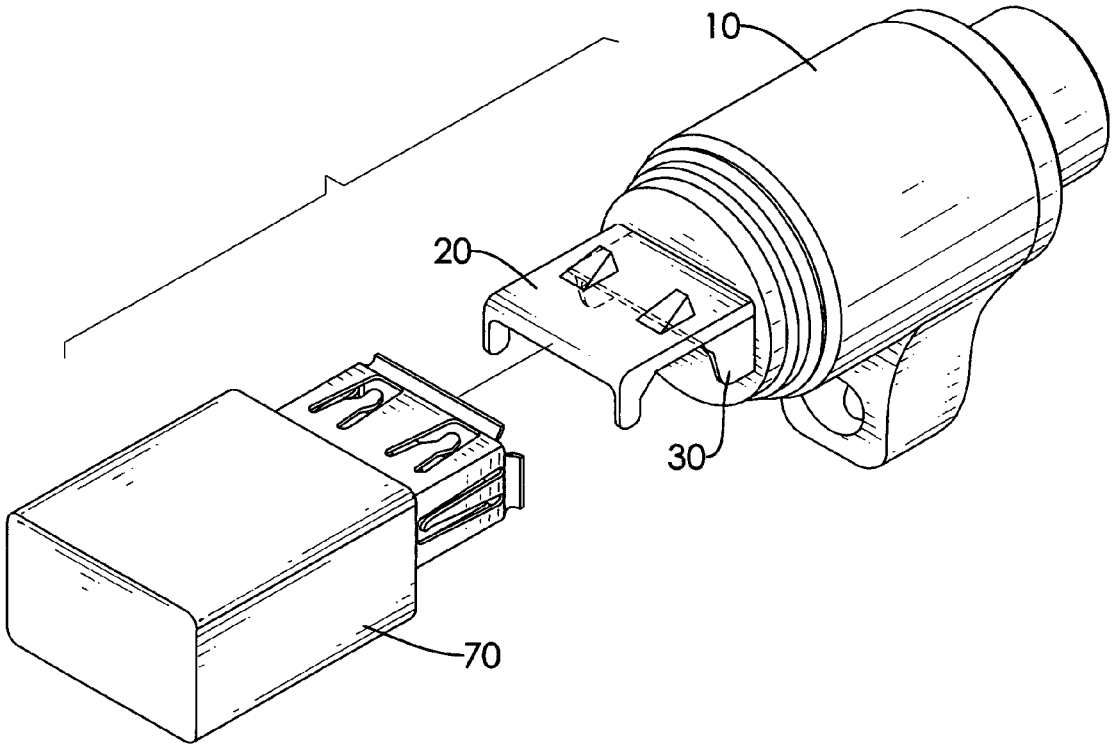
FIG. 2 is an operationally exploded perspective view of the lock in FIG. 1, shown unlocked from the USB port.
Figure 3:
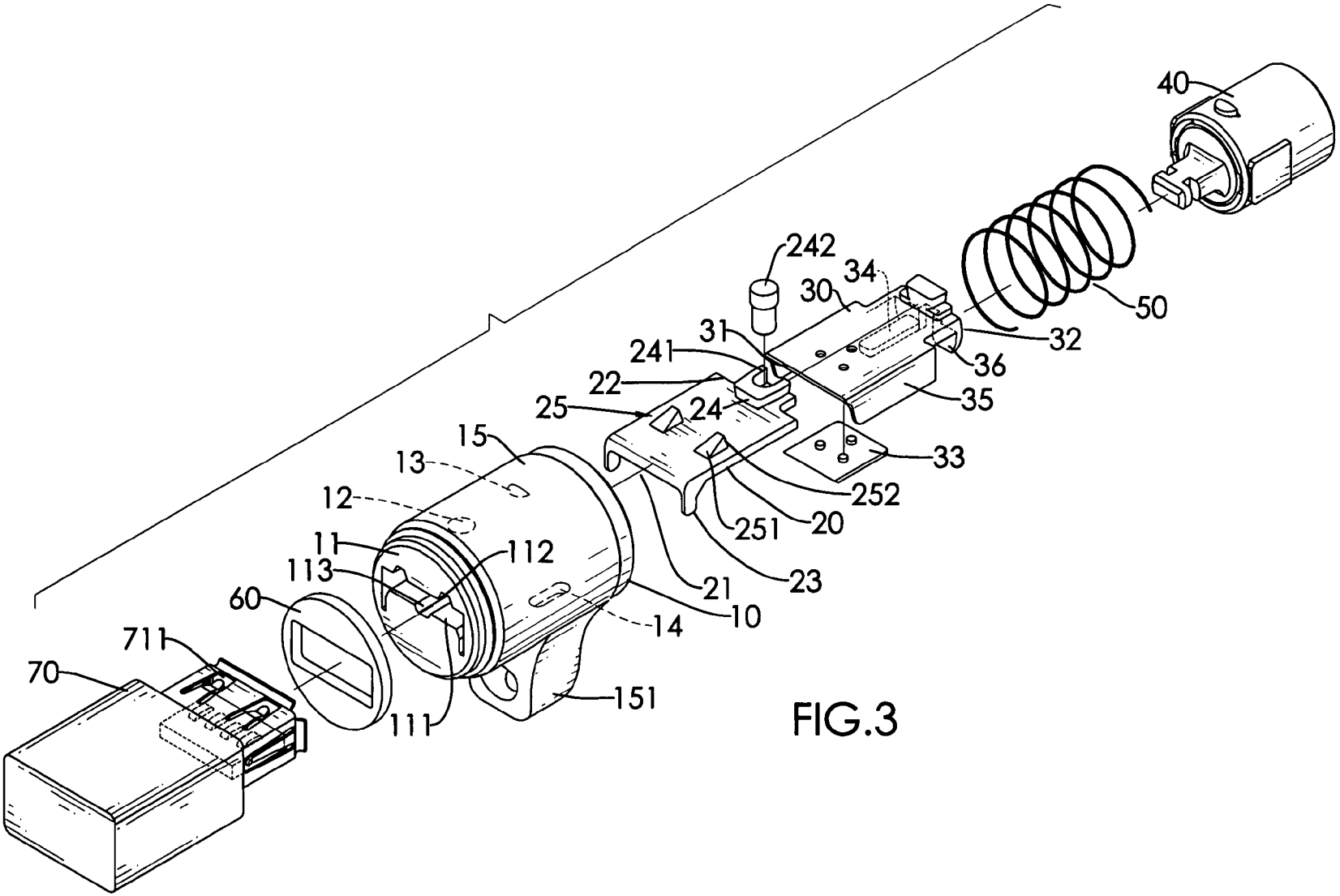
FIG. 3 is a partially exploded perspective view of the lock in FIG. 1, shown with the USB port.

With reference to FIGS. 1 to 3, a lock for universal serial bus (USB) ports in accordance with the present invention comprises a shell (10), an optional external sleeve (15), a tongue (20), a slide (30), a lock cylinder (40), an optional main spring (50) and an optional buffer (60).

The shell (10) is hollow, has a front end opening and a rear end opening and may comprise an inside wall, a front panel (11), a guiding channel (113), a fastening hole (12), a passing hole (13) and an elongated recess (14).

The front panel (11) is formed on and seals the front end opening and has a front surface, a rear surface, an upper side, a U-shaped slot (111) and two detents (112). The slot (111) is formed through the front panel (11) and has two ends. The detents (112) are formed through the front panel (11) near the upper side, communicate with the slot (111) and are respectively near the ends of the slot (111).

The guiding channel (113) is formed in the inside wall of the shell (10) and is formed through the front panel (11).

The fastening hole (12) is formed in the inside wall of the shell (10).

The passing hole (13) is formed in the inside wall of the shell (10) and may be semicircular.

The elongated recess (14) is formed in the inside wall of the shell (10) and is directly opposite to the passing hole (13).

The external sleeve (15) is mounted around the shell (10) and has a connecting extension (151) to connect with a cable.

The tongue (20) is mounted securely in the front end opening in the shell (10), has a distal end (21), a fastening end (22), a top surface, a bottom surface, two sides and two locking protrusions (25) and may have two guiding protrusions (23) and a limit (24).

The locking protrusions (25) are formed on and protrude adjacently out from the top surface of the tongue (20), and may correspond to the detents (112) of the front panel (11). Each locking protrusion (25) may respectively have an inclined surface (251) and a lateral surface (252). The inclined surface (251) is near the distal end of the tongue (20). The lateral surface (252) is near the fastening end of the tongue (20).

The guiding protrusions (23) are formed on the distal end (21) of the tongue (20) respectively on the sides of the tongue (20) and protrude out from the bottom surface of the tongue (20).

Figure 5:
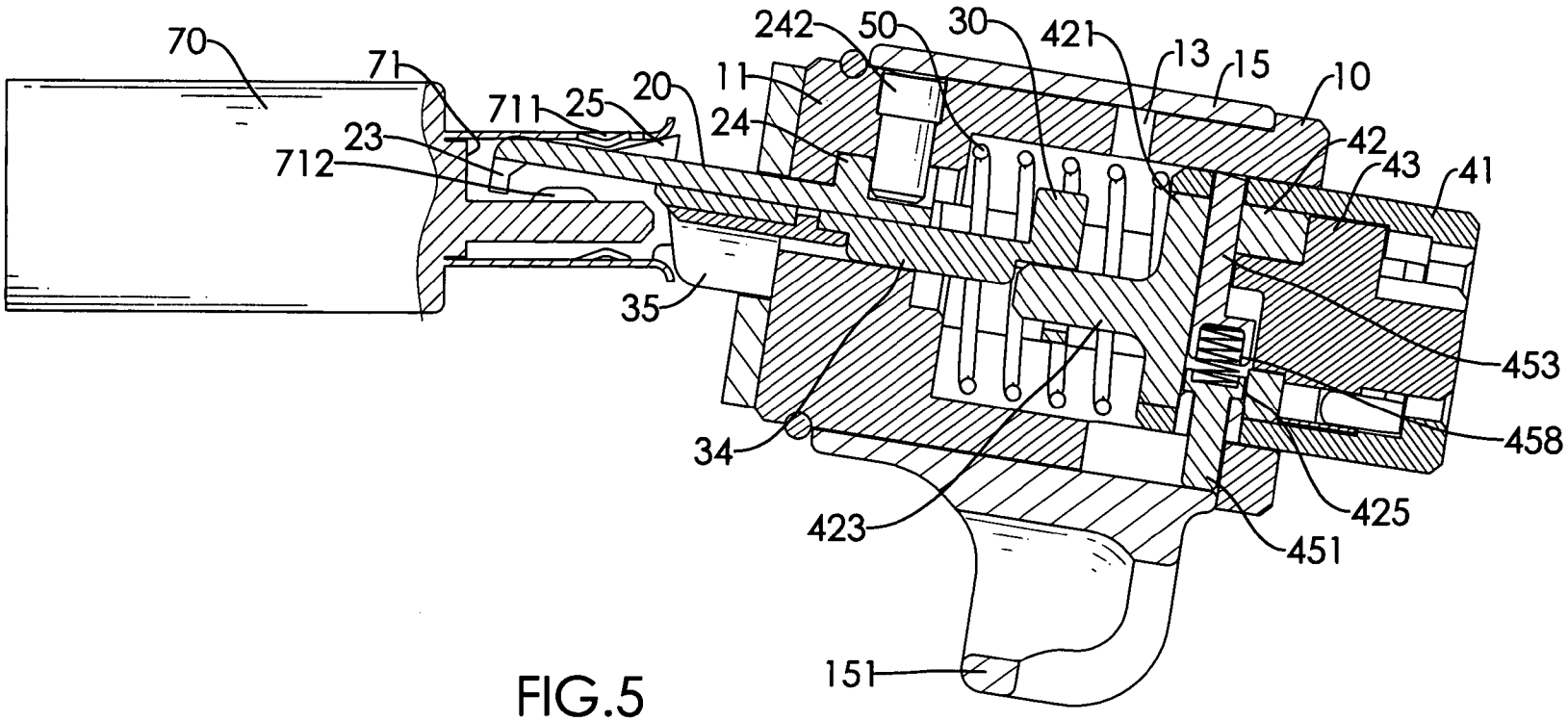
FIGS. 5, 6 and 7 are operational side views in partial section of the lock in FIG. 1, shown being plugged into the USB port and locked.

With further reference to FIG. 5, the limit (24) is formed on the fastening end (22) of the tongue (20) and has a rear surface, two side protrusions (241) and a fastening pin (242). The side protrusions (241) separately extend out from the rear surface of the limit (24). The fastening pin (242) is clamped between the side protrusions (241) and is mounted securely in the fastening hole (12) of the shell (10).

The slide (30) is mounted slidably in and extends from the front end opening of the shell (10), has a distal end (31), a fastening end (32), two sides, a bottom surface, two supporting wings (35), an optional insulating element (33), an optional guiding rib (34) and an optional U-shaped fastening clamp (36).

The supporting wings (35) are formed on the distal end (31) of the slide (30) respectively on the sides of the slide (30), protrude out from the bottom surface of the slide (30), selectively slide through the front end opening of the shell (10) and may selectively slide through the slot (111) in the front panel (11).

The insulating element (33) is made of a resilient, insulating material such as rubber and is attached to the bottom surface of the slide (30).

The guiding rib (34) is formed on the bottom surface of the slide (30) and is mounted slidably in the guiding channel (113) of the shell (10).

The fastening clamp (36) is formed on the fastening end (32) of the slide (30).

The lock cylinder (40) is mounted in the shell (10), is connected securely to the fastening end (32) of the slide (30) and selectively pushes out and retracts the slide (30) relative to the shell (10). The lock cylinder (40) may comprise a housing (41), a stationary segment (42), a rotatable segment (43), a locking pin assembly (44) and a lock actuating assembly (45).

The housing (41) is mounted in the shell (10) and has a sidewall, a through hole (411) and a passing hole (412). The through hole (411) is formed through the sidewall of the housing (41), corresponds to and aligns with the elongated recess (14) in the shell (10). The passing hole (412) is formed through the sidewall of the housing (41), corresponds to and aligns with the passing hole (13) in the shell (10) and may be semicircular.

The stationary segment (42) is tubular, is mounted in the housing (41) and has an outer end (421), an inner end (422), a sidewall, an extension rod (423), two fastening recesses (424), a through hole (425) and a passing hole (426). The extension rod (423) is formed longitudinally on the outer end of the stationary segment (42). The fastening recesses (424) are formed oppositely in the extension rod (423) and are clamped by the fastening clamp (36) of the slide (30) to connect the slide (30) securely to the stationary segment (42). The through hole (425) is formed through the sidewall of the stationary segment (42) and corresponds to and aligns with the through hole (411) in the housing (41). The passing hole (426) is formed through the sidewall of the stationary segment (42), corresponds to and aligns with the passing hole (412) in the housing (41) and may be semicircular.

The rotatable segment (43) is mounted in the housing (41) and has an outer end, an inner end, an active turning protrusion (431) and a central post (432). The active turning protrusion (431) is semicircular, is formed on the outer end of the rotatable segment (43) and extends into the stationary segment (42). The central post (432) is formed on the inner end of the rotatable segment (43).

The locking pin assembly (44) is mounted in the stationary and rotatable segments (42, 43). When the locking pin assembly (44) is locked, the rotatable segment (43) is restricted and cannot rotate with respect to the stationary segment (42). When the locking pin assembly (44) is unlocked, the rotatable segment (43) is allowed to rotate with respect to the stationary segment (42).

The lock actuating assembly (45) is mounted in the stationary segment (42) of the lock cylinder (40) and has a guide rod (451), an actuating rod (453), a stop spring (454) and a bearing (452).

The guide rod (451) is mounted in the stationary segment (42) of the lock cylinder (40) and has an outer end, an inner end, a head (455) and a receiving recess (456). The outer end of the guide rod (451) extends through the through holes (425, 411) of the stationary segment (42) and the housing (41) and extends into the elongated slot (14) in the shell (10). The head (455) is formed on the inner end of the guide rod (451). The receiving recess (456) is formed in the inner end of the guide rod (451).

The actuating rod (453) is mounted movably in the stationary segment (42) of the lock cylinder (40) and has an outer end, an inner end, an inactive turning protrusion (457) and a receiving recess (458). The outer end may be semicircular in cross section, extends through the passing holes (426,412) of the stationary segment (42) and the housing (41) and selectively extends into the passing hole (13) of the shell (10). The inactive turning protrusion (457) is formed on the inner end of the actuating rod (453) and abuts the active turning protrusion (431) of the rotatable segment (43) of the lock cylinder (40). The receiving recess (458) is formed in the inner end of the actuating rod (453) and corresponds to the receiving recess (456) of the guide rod (451).

The stop spring (454) is attached respectively to the inner ends of the guide rod (451) and the actuating rod (453) and may be mounted respectively in the receiving recesses (456, 458) of the guide rod (451) and the actuating rod (453).

The bearing (452) is mounted in the through hole (411) of the housing (41) and is mounted around the guide rod (451) to abut the head (455) of the guide rod (451) to hold the guide rod (451) in the housing (41).

The main spring (50) is mounted around the extension rod (423) of the stationary segment (42) and the slide (30) and selectively pushes the lock cylinder (40) out from the rear end opening of the shell (10).

The buffer (60) is attached to the front surface of the front panel (11).

Figure 4:
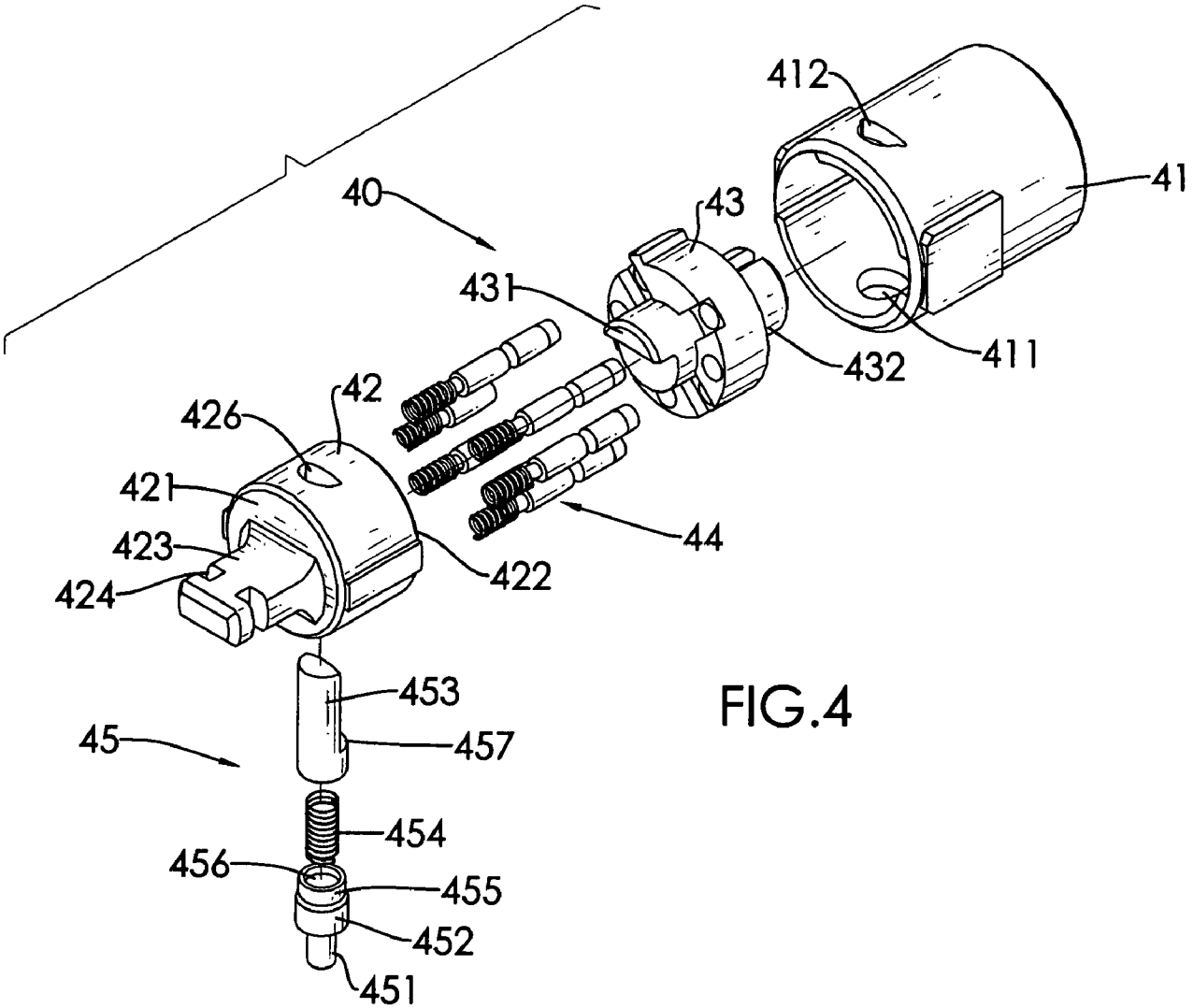
FIG. 4 is an exploded perspective view of a lock core assembly of the lock in FIG. 1.

With reference to FIGS. 3 to 5, the lock as described is locked into a USB port (70). The USB port (70) has a socket (71), two through holes (711) formed through a top of the socket (71) and multiple contacts (712) formed in a bottom of the socket (71). The distal end (21) of the tongue (20) is inserted obliquely into the socket (71).

Figure 6:
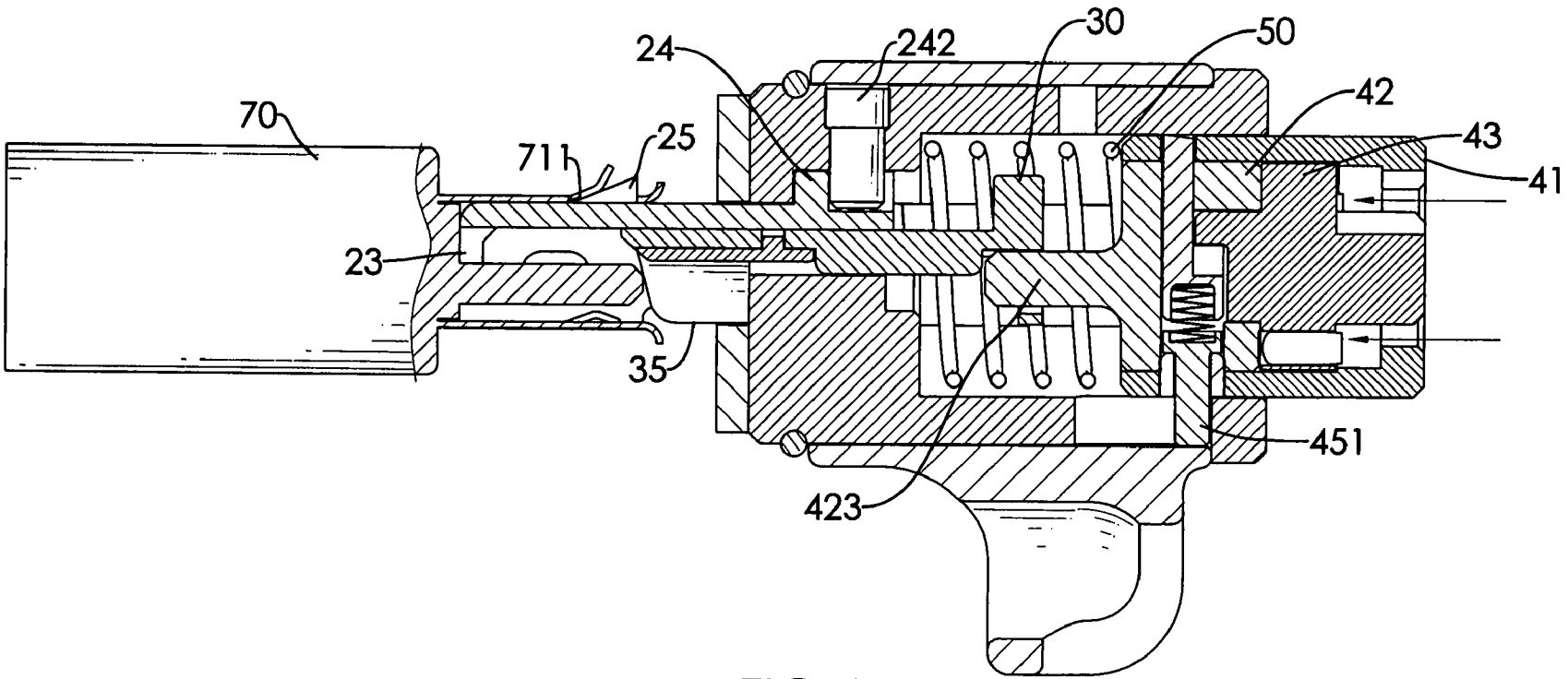
Figure 7:
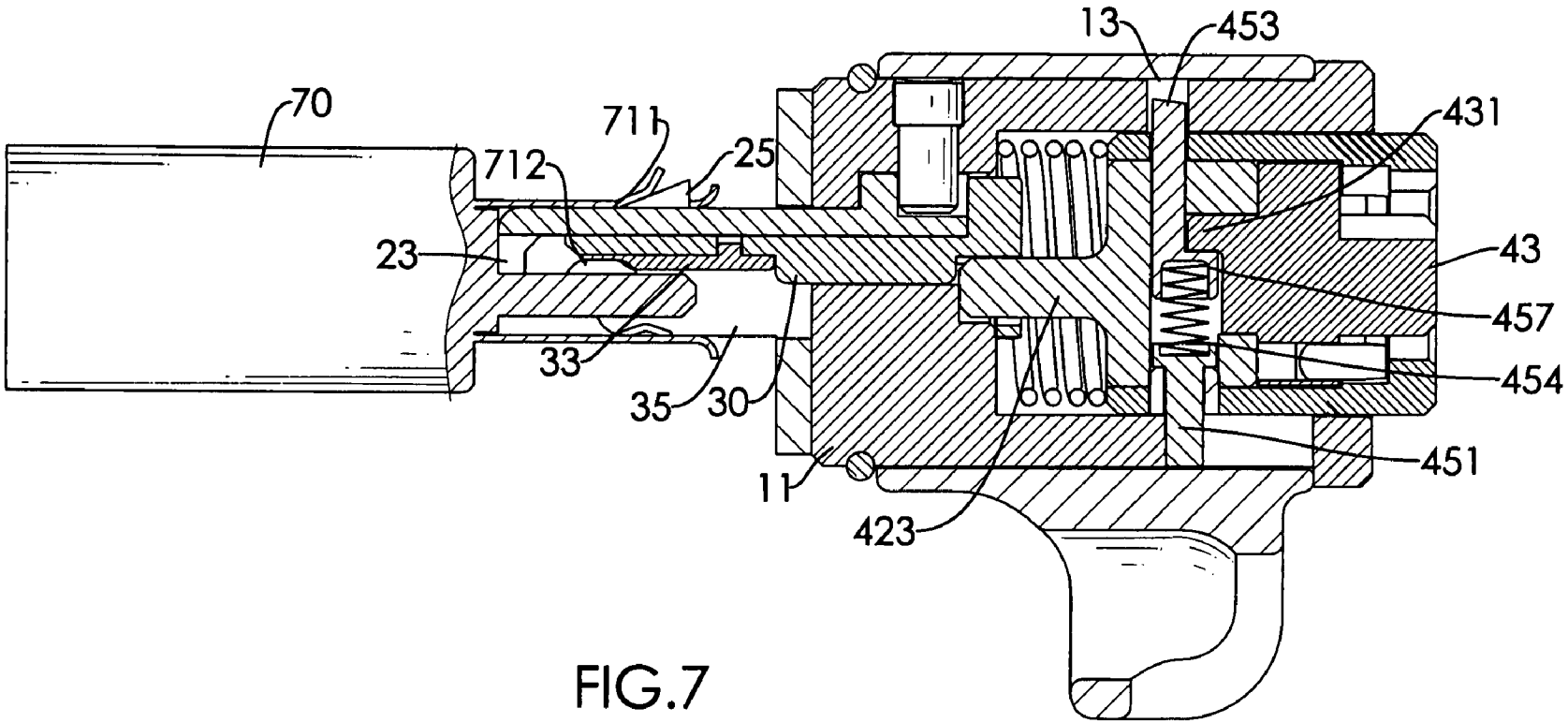

With further reference to FIGS. 6 and 7, the tongue (20) aligns with the socket (71), and the locking protrusions (25) engages the through holes (711) of the socket (71). Then the locking cylinder (40) is pressed into the shell (10) to push the slide (30) into the socket (71). The stop spring (457) pushes the actuating rod (453) to engage the passing hole (13) of the shell (10) to keep the slide (30) from moving axially along the shell (10). The insulating element (33) contacts the contacts (712) of the USB port (70) to avoid short or electric shock. Because the slide (30) is kept in the socket (71) and the supporting wings (35) stand on the bottom surface of the socket (71) to support the tongue (20), the locking protrusions (25) are kept engaging the through holes (711) of the socket (71). Therefore, the lock as described is locked into the USB port (70) to keep the USB port from being used without permission. Furthermore, the cable connecting to the external sleeve (15) may be fastened to a stationary object to prevent the electronic device with the USB port (70) from being moved.

When the user needs to unlock the USB port (70), the user has to insert a corresponding key in the lock cylinder (40) to unlock the lock cylinder (40). When the lock cylinder (40) is unlocked, the rotatable segment (43) is allowed to rotate relative to the stationary segment (42). The active turning protrusion (431) is rotated to push the inactive turning protrusion (457). Then the actuating rod (453) is retracted into the lock cylinder (40) to leave the passing hole (13) of the shell (10). The main spring (50) pushes the lock cylinder (40) to move out from the rear end opening of the shell (10), and the slide (30) is also pulled out of the socket (71). The locking protrusions (25) of the tongue (20) disengage from the through holes (711) of the socket (71). Therefore, the lock as described is unlocked from the USB port (70).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lock for locking a universal serial bus port comprising
a shell having a front end opening and a rear end opening;
a tongue mounted securely in the front end opening in the shell and having
a distal end;
a fastening end;
a top surface;
a bottom surface;
two sides; and
two locking protrusions formed on and protruding adjacently out from the top surface of the tongue;
a slide being mounted slidably in and extending from the front end opening of the shell and having
a distal end;
a fastening end;
two sides;
a bottom surface; and
two supporting wings being formed on the distal end of the slide respectively on the sides of the slide, protruding out from the bottom surface of the slide and selectively sliding through the front end opening of the shell; and
a lock cylinder being mounted in the shell, being connected securely to the fastening end of the slide and selectively pushing out and retracting the slide relative to the shell.

2. The lock as claimed in claim 1, wherein
the shell has
an inside wall;
a passing hole formed in the inside wall of the shell; and
an elongated recess formed in the inside wall of the shell and being directly opposite to the passing hole;
the slide has a fastening clamp formed on the fastening end of the slide;
the lock cylinder comprises
a housing mounted in the shell and having
a sidewall;
a through hole formed through the sidewall of the housing, corresponding to and aligning with the elongated recess in the shell; and
a passing hole formed through the sidewall of the housing, corresponding to and aligning with the passing hole in the shell;
a stationary segment mounted in the housing and having
an outer end;
an inner end;
a sidewall;
an extension rod being formed longitudinally on the outer end of the stationary segment;
two fastening recesses being formed oppositely in the extension rod and clamped by the fastening clamp of the slide;
a through hole being formed through the sidewall of the stationary segment, corresponding to and aligning with the through hole in the housing; and
a passing hole formed through the sidewall of the stationary segment, corresponding to and aligning with the passing hole in the housing;
a rotatable segment being mounted in the housing and having
an outer end;
an inner end;
an active turning protrusion being semicircular, formed on the outer end of the rotatable segment and extending into the stationary segment; and
a central post being formed on the inner end of the rotatable segment;
a locking pin assembly being mounted in the stationary and rotatable segments, selectively locking the rotatable segment to prevent rotation with respect to the stationary segment and unlocking the rotatable segment to allow rotation with respect to the stationary segment; and
a lock actuating assembly being mounted in the stationary segment of the lock cylinder and having
a guide rod being mounted in the stationary segment of the lock cylinder and having
an outer end extending through the through holes of the stationary segment and the housing and extending into the elongated recess in the shell; and
an inner end;
an actuating rod being mounted movably in the stationary segment of the lock cylinder and having
an outer end extending through the passing holes of the stationary segment and the housing and selectively extending into the passing hole of the shell;
an inner end; and
an inactive turning protrusion being formed on the inner end of the actuating rod and abutting the active turning protrusion of the rotatable segment of the lock cylinder; and
a stop spring being attached respectively to the inner ends of the guide rod and the actuating rod; and
the lock further comprises a main spring being mounted around the extension rod of the stationary segment and the slide and selectively pushing the lock cylinder out from the rear end opening of the shell.

3. The lock as claimed in claim 2, wherein
the guide rod has a head formed on the inner end of the guide rod; and
the lock actuating assembly has a bearing being mounted in the through hole of the housing and being mounted around the guide rod to abut the head of the guide rod.

4. The lock as claimed in claim 2, wherein
the guide rod has a receiving recess being formed in the inner end of the guide rod;
the actuating rod has a receiving recess being formed in the inner end of the actuating rod and corresponding to the receiving recess of the guide rod; and
the stop spring is mounted respectively in the receiving recesses of the guide rod and the actuating rod.

5. The lock as claimed in claim 3, wherein
the guide rod has a receiving recess being formed in the inner end of the guide rod;
the actuating rod has a receiving recess being formed in the inner end of the actuating rod and corresponding to the receiving recess of the guide rod; and
the stop spring is mounted respectively in the receiving recesses of the guide rod and the actuating rod.

6. The lock as claimed in claim 2, wherein
the passing hole in the shell is semicircular;
the passing hole in the housing is semicircular;
the passing hole in the stationary segment is semicircular; and
the outer end of the actuating rod is semicircular in cross section.

7. The lock as claimed in claim 5, wherein
the passing hole in the shell is semicircular;
the passing hole in the housing is semicircular;
the passing hole in the stationary segment is semicircular; and
the outer end of the actuating rod is semicircular in cross section.

8. The lock as claimed in claim 1, wherein
the shell further has a front panel formed on and sealing the front end opening and having
a front surface;
a rear surface;
an upper side;
a U-shaped slot being formed through the front panel and having two ends; and
two detents being formed through the front panel near the upper side, communicating with the slot, being respectively near the ends of the slot and corresponding to the locking protrusions of the tongue; and
the supporting wings of the slide selectively slide through the slot in the front panel.

9. The lock as claimed in claim 7, wherein
the shell further has a front panel formed on and sealing the front end opening and having
a front surface;
a rear surface;
an upper side;
a U-shaped slot being formed through the front panel and having two ends; and
two detents being formed through the front panel near the upper side, communicating with the slot, being respectively near the ends of the slot and corresponding to the locking protrusions of the tongue; and
the supporting wings of the slide selectively slide through the slot in the front panel.

10. The lock as claimed in claim 8, wherein
the shell has a guiding channel being formed in the inside wall of the shell and formed through the front panel; and
the slide has a guiding rib being formed on the bottom surface of the slide and mounted slidably in the guiding channel of the shell.

11. The lock as claimed in claim 9, wherein
the shell has a guiding channel being formed in the inside wall of the shell and formed through the front panel; and
the slide has a guiding rib being formed on the bottom surface of the slide and mounted slidably in the guiding channel of the shell.

12. The lock as claimed in claim 1, wherein
the shell has a fastening hole formed in the inside wall of the shell;
the tongue has a limit being formed on the fastening end of the tongue and having
a rear surface;
two side protrusions separately extending out from the rear surface of the limit; and
a fastening pin being clamped between the side protrusions and mounted securely in the fastening hole of the shell.

13. The lock as claimed in claim 11, wherein
the shell has a fastening hole formed in the inside wall of the shell;
the tongue has a limit formed on the fastening end of the tongue and having
a rear surface;
two side protrusions separately extending out from the rear surface of the limit; and
a fastening pin being clamped between the side protrusions and mounted securely in the fastening hole of the shell.

14. The lock as claimed in claim 1, wherein the slide has an insulating element being made of resilient, insulating material and being attached to the bottom surface of the slide.

15. The lock as claimed in claim 13, wherein the slide has an insulating element being made of resilient, insulating material and being attached to the bottom surface of the slide.

16. The lock as claimed in claim 1, wherein the tongue has two guiding protrusions formed on the distal end of the tongue respectively on the sides of the tongue and protruding out from the bottom surface of the tongue.

17. The lock as claimed in claim 15, wherein the tongue has two guiding protrusions formed on the distal end of the tongue respectively on the sides of the tongue and protruding out from the bottom surface of the tongue.

18. The lock as claimed in claim 1, wherein each locking protrusion has
an inclined surface being near the distal end of the tongue; and
a lateral surface being near the fastening end of the tongue.

19. The lock as claimed in claim 1 further comprising an external sleeve mounted around the shell and having a connecting extension.

20. The lock as claimed in claim 8 further comprising a buffer attached to the front surface of the front panel.

* * * * *